US009957916B2

(12) United States Patent
Tateno et al.

(10) Patent No.: US 9,957,916 B2
(45) Date of Patent: May 1, 2018

(54) INTERNAL COMBUSTION ENGINE

(71) Applicant: TOYOTA JIDOSHA KABUSHIKI KAISHA, Toyota-shi, Aichi-ken (JP)

(72) Inventors: Manabu Tateno, Suntou-gun (JP); Akio Kawaguchi, Suntou-gun (JP); Hideyuki Nishida, Suntou-gun (JP); Hideo Yamashita, Mishima (JP); Hiroki Iguma, Susono (JP); Akira Yamashita, Suntou-gun (JP); Kazuyasu Iwata, Fuji (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 28 days.

(21) Appl. No.: 15/034,209

(22) PCT Filed: Sep. 12, 2014

(86) PCT No.: PCT/JP2014/074769

§ 371 (c)(1),
(2) Date: May 4, 2016

(87) PCT Pub. No.: WO2015/072227

PCT Pub. Date: May 21, 2015

(65) Prior Publication Data

US 2016/0273484 A1 Sep. 22, 2016

(30) Foreign Application Priority Data

Nov. 12, 2013 (JP) ..... 2013-234182

(51) Int. Cl.
*F02F 3/14* (2006.01)
*C25D 11/04* (2006.01)
(Continued)

(52) U.S. Cl.
CPC ..... *F02F 3/14* (2013.01); *C25D 11/022* (2013.01); *C25D 11/04* (2013.01); *F02B 77/11* (2013.01);
(Continued)

(58) Field of Classification Search
CPC ..... F02M 2200/9038; F02F 3/10; F02F 3/12; F02F 3/00
See application file for complete search history.

(56) References Cited

U.S. PATENT DOCUMENTS 8,813,718 B2 * 8/2014 Malfa ..... F02B 23/08 123/307
8,813,734 B2 * 8/2014 Kadoshima ..... F02B 77/11 123/193.1
(Continued)

FOREIGN PATENT DOCUMENTS

JP 61-142320 6/1986
JP S62-240460 A 10/1987
(Continued)

*Primary Examiner* — Long T Tran
(74) *Attorney, Agent, or Firm* — Finnegan, Henderson, Farabow, Garrett & Dunner, LLP

(57) ABSTRACT

The present invention relates to an internal combustion engine. An object of the invention is to allow an effect produced by an anodic oxide film to be exerted while suppressing a decrease in the combustion rate. A piston 10 includes a cavity portion 20 and a tapered portion 26 that is formed so as to surround the cavity portion 20 on an outer side thereof. The diameter of the tapered portion 26 decreases progressively in the downward direction from the top face side of the piston. A squish portion 28 is formed on an outer side of the tapered portion 26. An anodic oxide film 30 is formed on a surface (tapered face) of the tapered portion 26 and a surface (squish face) of the squish portion 28. The anodic oxide film 30 is not formed on the surface (cavity face) of the cavity portion 20.

4 Claims, 18 Drawing Sheets

(51) Int. Cl.

| | |
|---|---|
| ***F02F 3/12*** | (2006.01) |
| ***C25D 11/02*** | (2006.01) |
| ***F02B 77/11*** | (2006.01) |
| ***F02F 3/26*** | (2006.01) |

(52) U.S. Cl.
CPC ..... *F02F 3/12* (2013.01); *F02F 3/26* (2013.01); *F05C 2251/048* (2013.01)

(56) References Cited

U.S. PATENT DOCUMENTS

| | | | | |
|---|---|---|---|---|
| 2011/0203544 | A1 | 8/2011 | Katou | |
| 2015/0191607 | A1* | 7/2015 | McDaniel | C09D 5/008 424/409 |
| 2015/0204233 | A1* | 7/2015 | Nanba | F02F 1/18 123/668 |

FOREIGN PATENT DOCUMENTS

| | | | |
|---|---|---|---|
| JP | H05-057316 | U | 7/1993 |
| JP | 2000-186617 | A | 7/2000 |
| JP | 2003-211002 | A | 7/2003 |
| JP | 2008-151089 | A | 7/2008 |
| JP | 2009-046985 | A | 3/2009 |
| JP | 2011-220207 | | 11/2011 |
| JP | 2012-041853 | A | 3/2012 |
| JP | 2012-72745 | | 4/2012 |
| JP | 2012-122445 | | 6/2012 |

* cited by examiner

INTERNAL COMBUSTION ENGINE

CROSS-REFERENCE TO RELATED APPLICATIONS

This application is a national phase application of International Application No. PCT/JP2014/074769, filed Sep. 12, 2014, and claims the priority of Japanese Application No. 2013-234182, filed Nov. 12, 2013, the content of both of which is incorporated herein by reference.

BACKGROUND OF THE INVENTION

Field of the Invention

This invention relates to an internal combustion engine, and more particularly to an internal combustion engine that includes a piston on which a film (anodic oxide film) is formed by an anodic oxidation treatment.

Background Art

An anodic oxide film that includes a porous layer that is formed by subjecting a top face of a piston base material made of an aluminum alloy to an anodic oxidation treatment, and a film layer that is formed by plasma spraying of a $Y_2O_3$-stabilized $ZrO_2$ powder onto the surface of the porous layer is known, as disclosed, for example, in Japanese Patent Laid-Open No, 2012-72745. The porous layer has a large number of pores that are formed during the course of the anodic oxidation treatment, and the film layer is provided so as to seal the pores. Because an anodic oxide film having such a structure has a lower thermal conductivity and a lower thermal capacity than a conventional ceramic-based insulation film, the anodic oxide film is useful for reducing the cooling loss of an internal combustion engine. Further, according to the aforementioned Japanese Patent Laid-Open No. 2012-72745, a sealing treatment is performed after a convex-concave pattern is formed on the surface of the porous layer to improve a bonding property with respect to a coating layer, and thereafter the coating layer is formed by a finishing process. As a result, roughness in the coating layer that is produced by formation of the convex-concave pattern is smoothed.

Japanese Patent Laid-Open No. 2012-122445 discloses an anodic oxide film in which a metal such as platinum is carried inside pores of a porous layer formed by subjecting a top face of a piston base material to an anodic oxidation treatment. Unlike Japanese Patent Laid-Open No. 2012-72745, a sealing treatment is not performed on the porous layer according to Japanese Patent Laid-Open No. 2012-122445. However, according to the anodic oxide film described in Japanese Patent Laid-Open No. 2012-122445, soot generated inside a combustion chamber can be oxidized and purified by a catalytic action of the metal.

Japanese Patent Laid-Open No. 61-142320 discloses that a heat insulating material such as $ZrO_2$ is coated on or adhered to side faces of a combustion chamber that correspond to a dead volume of the combustion chamber in the vicinity of the top dead center of a direct injection type or divided chamber type diesel engine, that is, a top face and an upper side face of a piston, a non-sliding face of an upper portion of a cylinder liner, and an outer circumferential portion of a face on the combustion chamber side of the cylinder head. The heat insulating material described in Japanese Patent Laid-Open No. 61-142320 is a so-called "ceramic-based heat insulating material" and not an anodic oxide film.

SUMMARY OF THE INVENTION

The anodic oxidation treatment described in Japanese Patent Laid-Open No. 2012-72745 and Japanese Patent Laid-Open No. 2012-122445 is a treatment in which forms innumerable pores from the surface of the relevant piston towards the inside thereof while oxidizing aluminum that is the piston base material. Therefore, the surface of the porous layer that is formed after the anodic oxidation treatment is not smooth, and a certain amount of surface roughness exists. A similar situation arises when a porous layer is subjected to sealing treatment as described in Japanese Patent Laid-Open No. 2012-72745. Therefore, when an anodic oxide film is formed on the surface of a piston, there is a possibility that flame growth will be inhibited in the region in which the film is formed and the combustion rate will decrease.

The present invention has been conceived to solve the above described problem. That is, an object of the present invention is to allow an effect produced by an anodic oxide film to be exerted while suppressing a decrease in the combustion rate.

Means for Solving the Problem

To achieve the above mentioned purpose, a first aspect of the present invention is an internal combustion engine comprising a piston in which an anodic oxide film is formed on at least one part of a top face that faces a cylinder head, and an injection valve that is capable of injecting a fuel towards the top face, wherein:

the top face includes: a cavity face which comprises a cavity for causing fuel that is injected to ignite, a squish face which comprises an outer circumference of the top face at an outer side of the cavity face, and a tapered face which is formed between the squish face and the cavity face;

a rough surface region in which the anodic oxide film is formed is provided over an entire area of the squish face; and the rough surface region and a smooth surface region in which a surface roughness is less than on the squish face that is provided by formation or non-formation of the anodic oxide film are provided in a region that includes the cavity face and the tapered face.

A second aspect of the present invention is the internal combustion engine according the first aspect, wherein:

a plurality of injection holes are radially provided in a tip of the injection valve; and the smooth surface region is provided in band-like regions that, in a case where the piston is positioned at a top dead center, pass through respective points of intersection of the cavity face that intersects with straight lines that pass through respective centers of the injection holes, and also extend from the relevant points of intersection to a center of the cavity face and to the squish face.

A third aspect of the present invention is the internal combustion engine according to the first or the second aspect, wherein:

a ridge portion that rises from a center of the piston towards the cylinder head is formed at a center portion of the cavity; and the rough surface region is provided on a surface of an apex portion and a mid-slope portion of the ridge portion, and the smooth surface region is provided on a surface of a base portion of the ridge portion.

A fourth aspect of the present invention is the internal combustion engine according to any one of the first to third aspects, wherein the rough surface region is provided in an entire area of the tapered face.

Effects of the Invention

According to the present invention, since a smooth surface region is provided in a region that includes a cavity face and a tapered face, suppression of flame growth in a region of a top face that a flame at an initial formation stage contacts can be suppressed. Further, since a rough surface region in which an anodic oxide film is formed is provided over the entire area of a squish face, an effect produced by the film can be exerted in a region of the top face that a flame that is at a latter stage of growth contacts.

BEST MODE OF CARRYING OUT THE INVENTION

First Embodiment

First, a first embodiment of the present invention will be described referring to FIG. 1 and FIG. 2.

Figure 1:
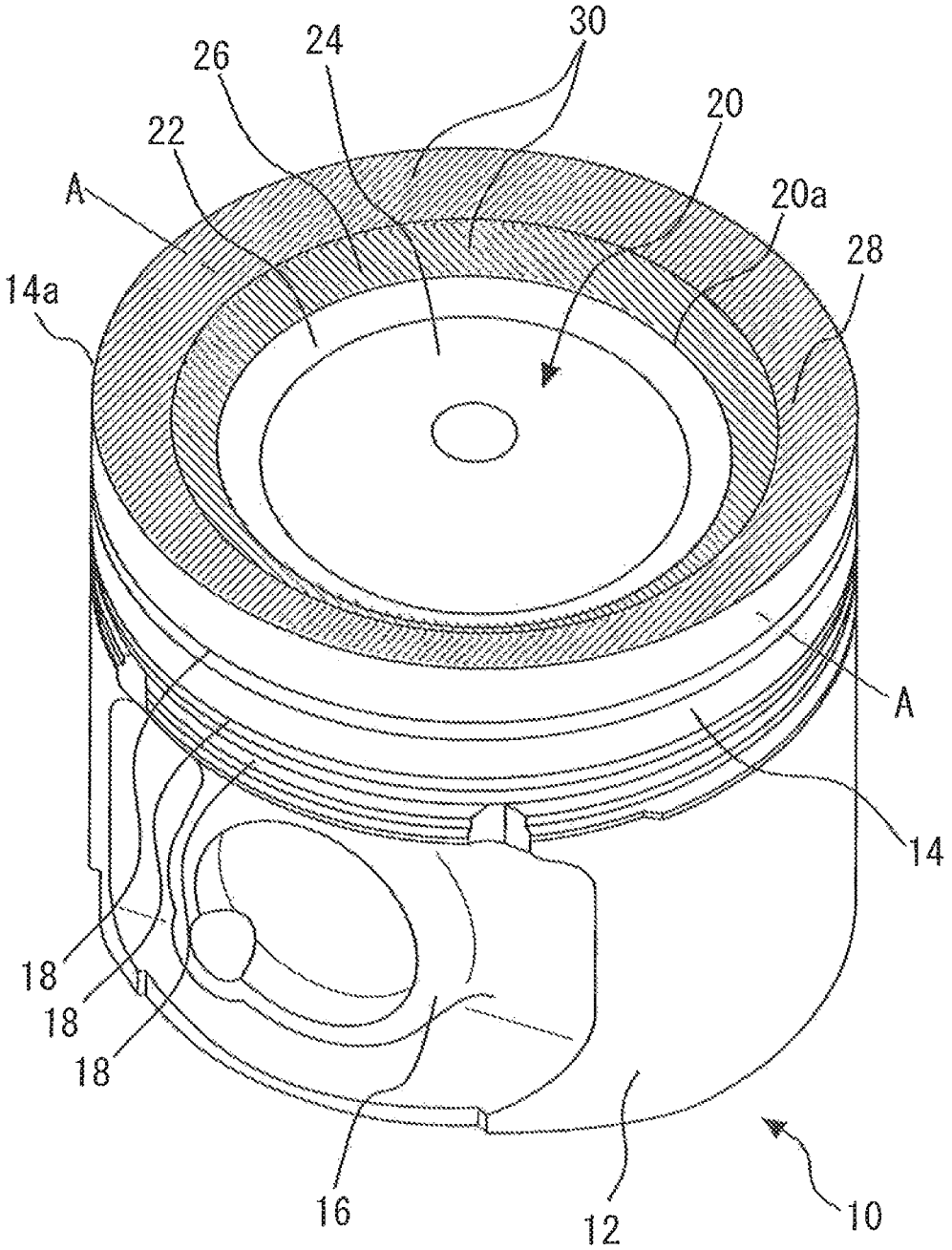
FIG. 1 is a perspective view of a piston that is applied to an internal combustion engine of the first embodiment.

FIG. 1 is a perspective view of a piston that is applied to an internal combustion engine of the first embodiment. As shown in FIG. 1, a piston 10 is constituted by a cylindrical skirt portion 12 having a side face that slidingly contacts an inner face of a cylinder block (not shown), a crown portion 14 having a predetermined wall thickness that is formed at an upper end portion of the skirt portion 12, and a pin boss portion 16 that supports a piston pin not shown).

Three piston ring grooves 18 are formed on the side face of the crown portion 14. A cavity portion 20 is recessed in the center of the top face (hereunder, also referred to as "piston top face") of the crown portion 14. The cavity portion 20 is constituted by a side wall portion 22 that is formed so as to face the inner part of the crown portion 14 from an opening edge 20*a* of the cavity portion 20, and a truncated cone-shaped ridge portion 24 that is formed to rise upward from a deepest part of the side wall portion 22. A tapered portion 26 is formed at the outer side of the cavity portion 20 so as to surround the cavity portion 20. The diameter of the tapered portion 26 progressively decreases in the downward direction from the piston top face side. A squish portion 28 of the same height as an outer edge 14*a* of the crown portion 14 is formed on the outside of the cavity portion 20.

An anodic oxide film 30 is formed over the entire surface of the tapered portion 26 (hereunder, also referred to as "tapered face") and over the entire surface of the squish portion 28 (hereunder, also referred to as "squish face"). The anodic oxide film 30 is constituted by a porous anodic oxide film and a sealant. The porous anodic oxide film is a film (alumite film) formed by subjecting an aluminum alloy that is the base material of the piston 10 to anodic oxidation treatment. The sealant is provided for the purpose of sealing pores formed in the process of the anodic oxidation treatment and suppressing thermal fatigue of the alumite film. A material (preferably polysilazane) in which a heat-resistant material such as silica is used as a main ingredient is used as the sealant.

Naturally, the anodic oxide film 30 has a lower thermal conductivity and a lower thermal capacity than the aluminum alloy, and the anodic oxide film 30 also has a lower thermal conductivity and a lower thermal capacity than a conventional ceramic-based insulation film. Therefore, rather than constantly maintaining the film formation surface at a high temperature as in the case of the ceramic-based insulation film, it is possible to cause the temperature of the film formation surface to follow the temperature of gas that fluctuates during the cycle of the internal combustion engine. That is, the temperature of the film formation surface can be made a low temperature during a period from an intake stroke to a compression stroke (the upstroke in the case of a two-cycle engine), and made a high temperature during a period from an expansion stroke to an exhaust stroke (the downstroke in the case of a two-cycle engine). Accordingly, since not only the thermal efficiency of the internal combustion engine but also the air intake efficiency thereof can be improved by forming the anodic oxide film 30, advantageous effects of improving the fuel consumption and reducing the amount of NOx emissions are obtained.

However, the anodic oxide film 30 is not formed on the surface of the cavity portion 20 (hereunder, also referred to as "cavity face"). That is, the anodic oxide film 30 is formed on the tapered face and the squish face, and is not formed on the cavity face. The reason two regions are provided in this manner is related to the surface roughness of the anodic oxide film 30. That is, the surface roughness (arithmetic average roughness Ra) of the alumite film is from 6.0 to 8.0

μm, and the surface roughness of the anodic oxide film 30 after the sealing treatment is 3.0 to 4.0 μm. On the other hand, the surface roughness of the cavity face is equal to the surface roughness (0.5 to 1.5 μm) of the aluminum alloy. Note that these arithmetic average roughness Ra values were measured in accordance with JIS B 601 (2001).

Figure 2:
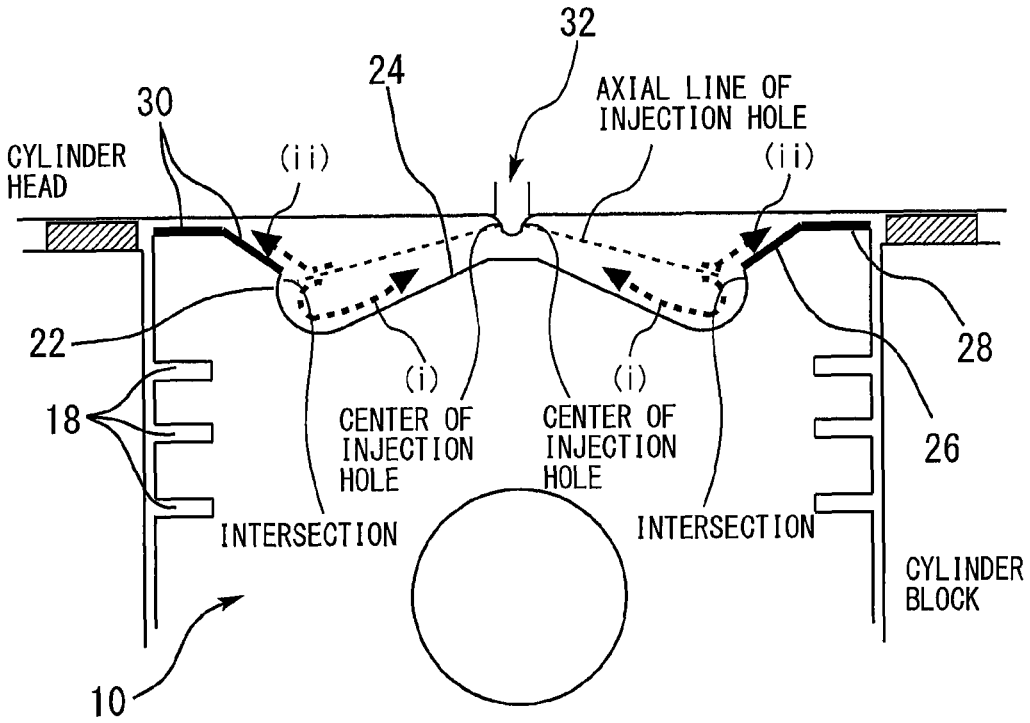
FIG. 2 is a cross-sectional view illustrating the structure of the internal combustion engine of the first embodiment.

FIG. 2 is a cross-sectional view illustrating the structure of the internal combustion engine of the first embodiment. FIG. 2 corresponds to a cross section A-A in FIG. 1. In FIG. 2, the piston 10 is positioned at the compression top dead center. Injection of fuel from an injection valve is performed prior to the compression top dead center so that the fuel combusts in the vicinity of the compression top dead center. Since injection holes are provided in the tip of the injection valve 32, fuel injected from the injection holes is injected towards the side wall portion 22 along axial lines of the injection holes as shown in FIG. 2, and the fuel ignites on the way from the injection holes to the side wall portion 22. Broken-line arrows in FIG. 2 show directions in which the flame grows. That is, a flame grows by separating into a main flow (arrow (i)) that collides with the surface of the side wall portion 22 and is deflected thereby and flows over the surface of the ridge portion 24 (hereunder, also referred to as "raised face"), and a branch flow (arrow (ii)) that flows so as run up the tapered face.

As shown in FIG. 2, the anodic oxide film 30 is not formed in the growth direction of the main flow. Therefore, it is possible to favorably suppress the occurrence of a situation in which the flame growth is inhibited by the anodic oxide film 30 and the combustion rate (average combustion rate in the cylinder) decreases. On the other hand, the anodic oxide film 30 is formed in the growth direction of the branch flow. However, since a flame forming the branch flow can receive the assistance of a reverse squish flow that is produced by the descent of the piston 50 at the time of combustion and can flow towards the squish portion 28 side, the influence on the combustion rate is small in comparison to the flame forming the main flow. For such reasons, according to the present embodiment the anodic oxide film 30 is formed on the tapered face, thereby enhancing the effect produced by the film.

Thus, according to the present embodiment, by forming the anodic oxide film 30 on the tapered face, the effect produced by the film can be enhanced. Note that the piston 10 described using FIG. 1 and FIG. 2 can be manufactured by subjecting the top face of the piston to an anodic oxidation treatment while sealing (with a rubber seal or the like) the cavity face, and thereafter performing a sealing treatment.

Although the anodic oxide film 30 is not formed on the cavity face in the above described first embodiment, a configuration may also be adopted in which the anodic oxide film 30 is formed on the cavity face. However, in this case, after forming the anodic oxide film 30 over the entire top face of the piston, polishing is performed using a polishing technique that has directivity (for example, aero-lapping) so that the surface roughness of the cavity face becomes a roughness between 0.5 and 1.5 μm, if this kind of smooth surface region is provided, the same effects as in the above described first embodiment can be obtained. Note that the present modification can also be similarly applied to the embodiments described hereunder.

Second Embodiment

Next, a second embodiment of the present invention will be described referring to FIG. 3 and FIG. 4. Note that components that are the same as in the first embodiment are denoted by the same reference numerals and a description of such components is omitted below.

Figure 3:
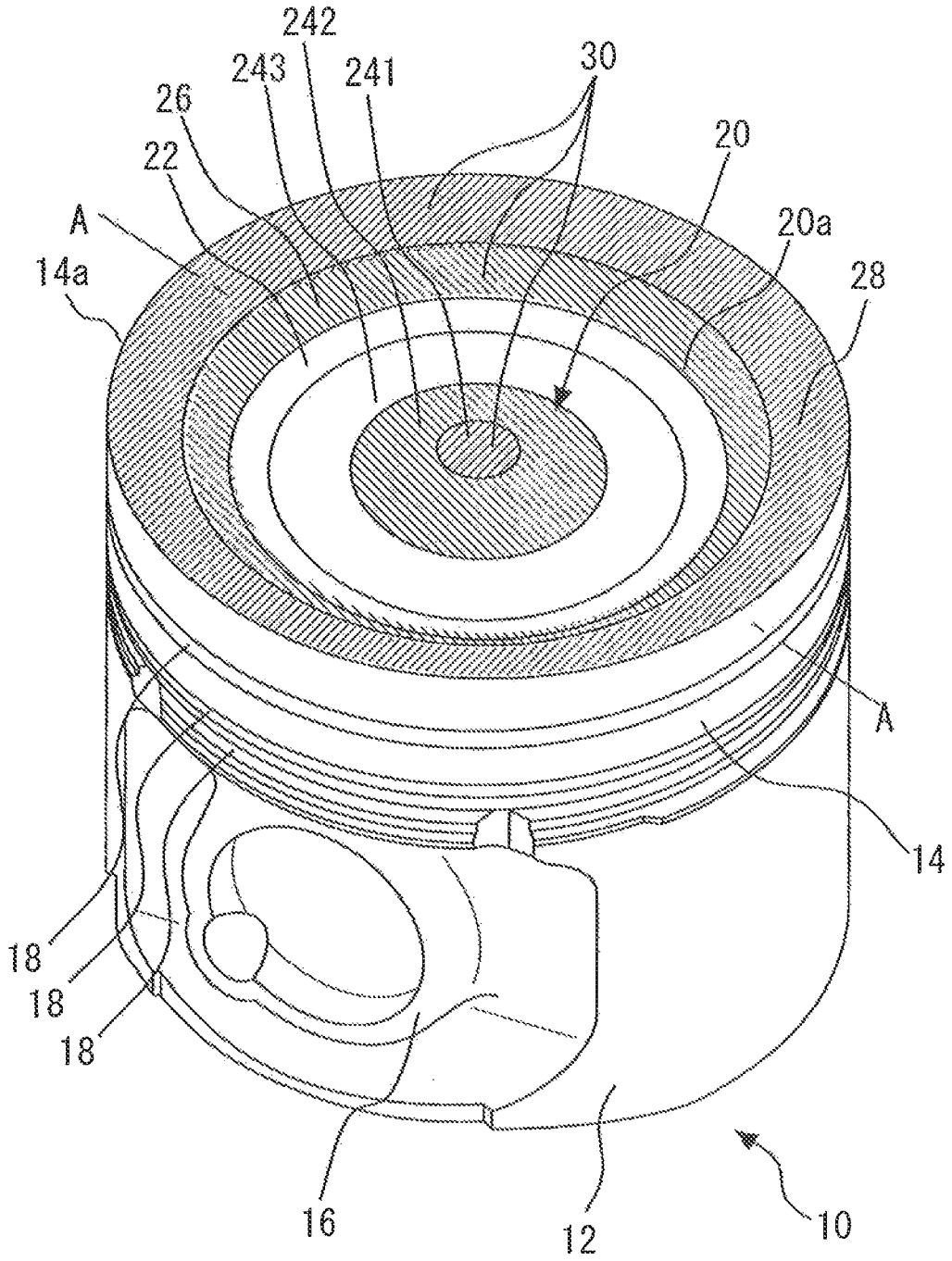
FIG. 3 is a perspective view of a piston that is applied to an internal combustion engine according to the second embodiment.

FIG. 3 is a perspective view of a piston that is applied to an internal combustion engine according to the second embodiment. As shown in FIG. 3, the anodic oxide film 30 is formed on a tapered face and a squish face. The anodic oxide film 30 is also formed on the surface of an apex portion 241 and a mid-slope portion 242 of the ridge portion 24. On the other hand, the anodic oxide film 30 is not formed on the surface of a base portion 243 of the ridge portion 24 or the surface of the side wall portion 22.

Figure 4:
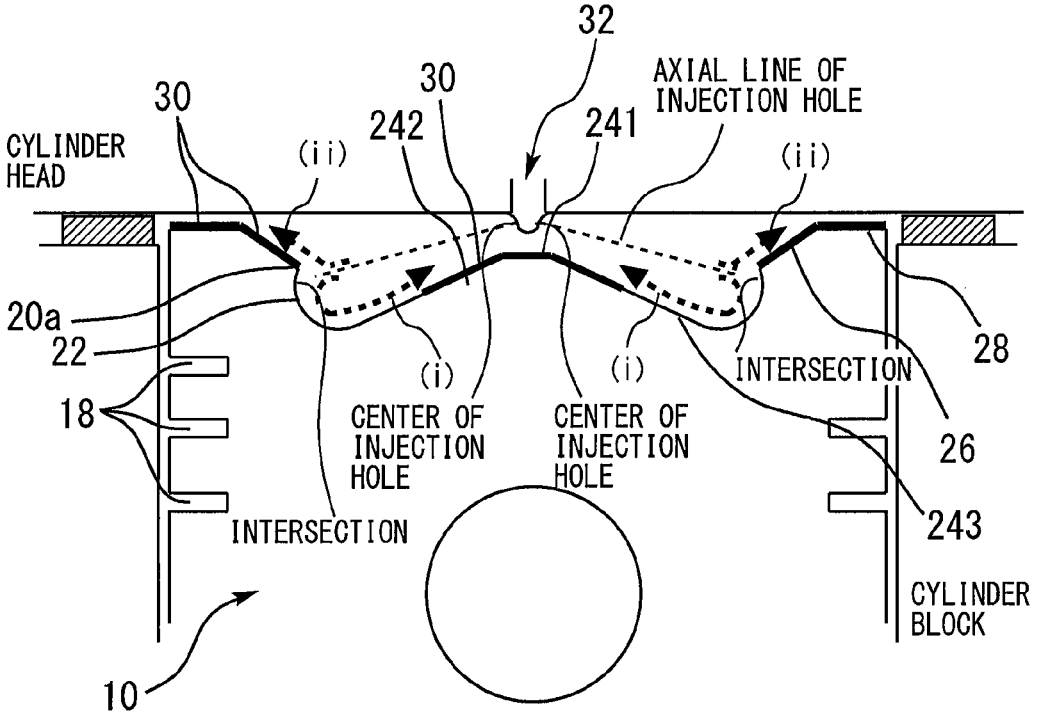
FIG. 4 is a cross-sectional view that illustrates the structure of the internal combustion engine of the second embodiment.

FIG. 4 is a cross-sectional view that illustrates the structure of the internal combustion engine of the second embodiment. FIG. 4 corresponds to a cross section A-A in FIG. 3. In FIG. 3, the piston 10 is positioned at the compression top dead center. As described above with regard to FIG. 2, the growth of a flame that forms the main flow (arrow (i) in FIG. 4) is inhibited by the anodic oxide film 30. However, since a flame that is at a latter stage of growth contacts the surface of the apex portion 241 and the surface of the mid-slope portion 242, the influence on the combustion rate is small in comparison to the surface of the base portion 243 or the surface of the side wall portion 22 that a flame at an initial formation stage contacts. For this reason, in the present embodiment the anodic oxide film 30 is formed on the surface of the apex portion 241 and the mid-slope, portion 242, thereby enhancing the effect produced by the film.

As described above, a similar effect as in the foregoing first embodiment can be obtained according to the present embodiment. Note that the piston 10 described using FIG. 3 and FIG. 4 can be manufactured by subjecting the top face of the piston to an anodic oxidation treatment in a state in which the surface of the base portion 243 and the side wall portion 22 are sealed, and thereafter performing a sealing treatment.

Third Embodiment

Next, a third embodiment of the present invention will be described referring to FIG. 5 and FIG. 6. Note that components that are the same as in the above described embodiments are denoted by the same reference numerals and a description of such components is omitted below.

Figure 5:
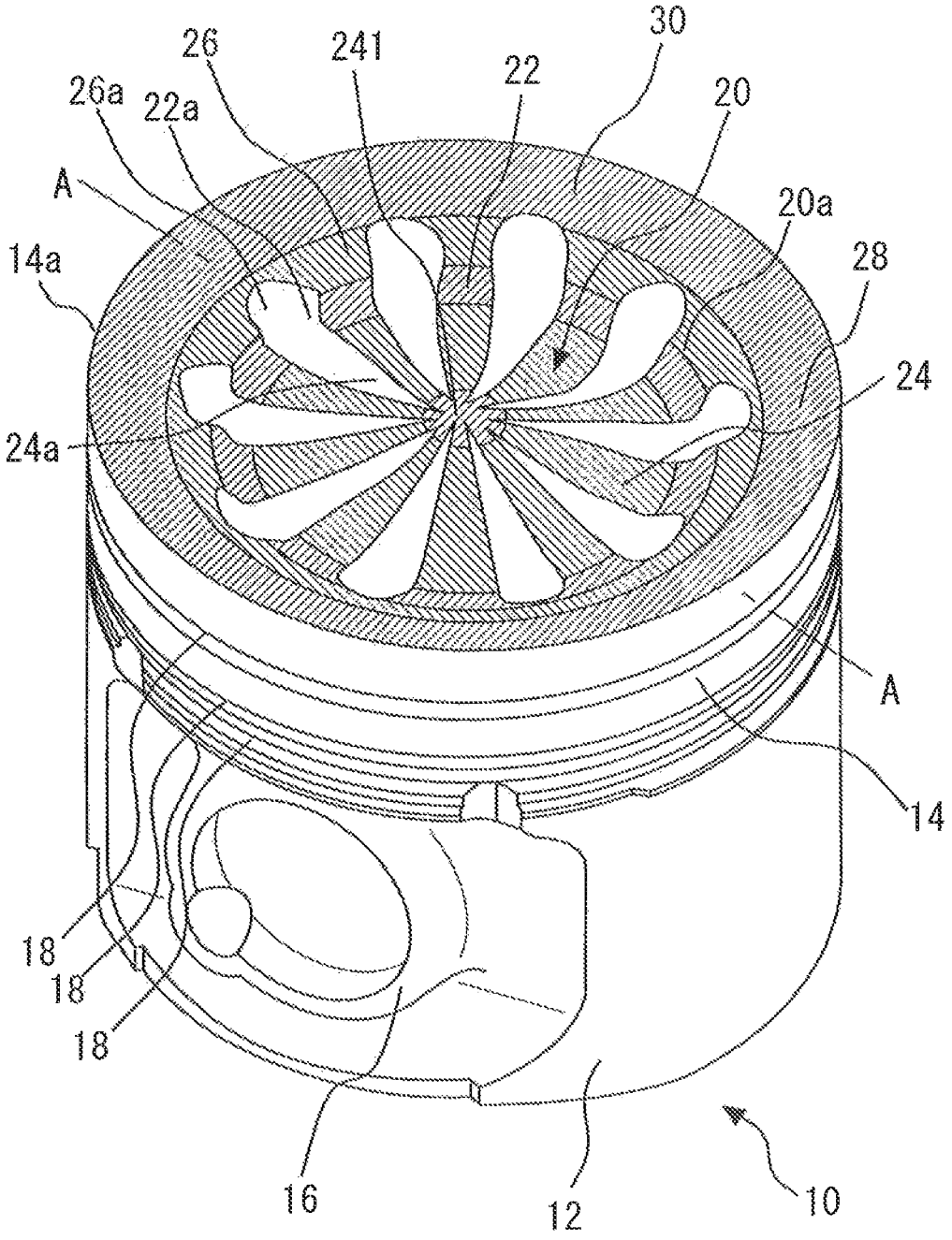
FIG. 5 is a perspective view of a piston that is applied to an internal combustion engine of the third embodiment.

FIG. 5 is a perspective view of a piston that is applied to an internal combustion engine of the third embodiment. As shown in FIG. 5, a plurality of regions **22*a* in which the anodic oxide film 30 is not formed are provided on the surface of the side wall portion 22. Likewise, a plurality of regions 24*a* in which the anodic oxide film 30 is not formed are provided on the raised face. Furthermore, a plurality of regions 26*a* in which the anodic oxide film 30 is not formed are provided on the tapered face. The regions 22*a*, 24*a* and 26*a* are provided at uniform intervals, and the respective regions 22*a*, regions 24*a* and regions 26*a* are formed continuously with each other to form band-like regions. However, the respective band-like regions are not connected to each other. The width of each band-like region is widest in the vicinity of the opening edge 20*a*, and the width narrows progressively from the vicinity of the opening edge 20*a* towards the squish portion 28 side and the apex portion 241 side. The number of band-like regions corresponds to the number of injection holes that are radially provided in the tip of the injection valve 32. The anodic oxide film 30** is formed on the top face of the piston, excluding the area of the band-like regions.

Figure 6:
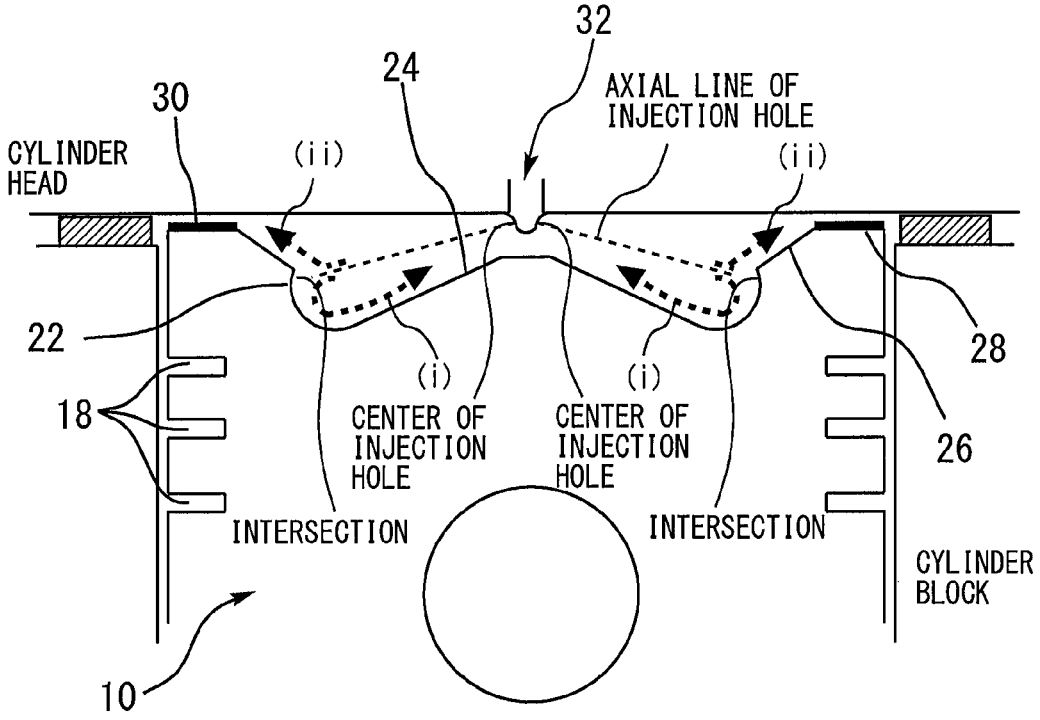
FIG. 6 is a cross-sectional view that illustrates the structure of the internal combustion engine of the third embodiment.

FIG. 6 is a cross-sectional view that illustrates the structure of the internal combustion engine of the third embodiment. FIG. 6 corresponds to a cross section A-A in FIG. 5. In FIG. 6, the piston 10 is positioned at the compression top dead center. As described above with regard to FIG. 2, a flame forming the branch flow (arrow (ii) in FIG. 6) has little influence on the combustion rate in comparison to a flame forming the main flow (arrow (i) in FIG. 6). However, if the regions in which the flame forming the branch flow grows (that is, the regions 26*a*) are configured as regions in which the anodic oxide film 30 is not formed, naturally, inhibition of growth of the flame can be suppressed. In addition, in the present embodiment, the regions in which the flame forming the main flow (that is, the regions 22*a* and regions 24*a*) grows are configured as regions in which the anodic oxide film 30 is not formed. Thus, both an effect of suppressing a decrease in the combustion rate and the effect produced by the anodic oxide film 30 can be obtained in a compatible manner.

As described above, similar effects as in the foregoing first embodiment can be obtained according to the present embodiment. Note that the piston 10 described using FIG. 5 and FIG. 6 can be manufactured by subjecting the top face of the piston to an anodic oxidation treatment in a state in which the band-like regions that respectively pass through points of intersection between the surface of the side wall portion 22 and an axial line of an injection hole and also extend to both the squish portion 28 side and the apex portion 241 side from the relevant point of intersection are sealed, and thereafter performing a sealing treatment.

Fourth Embodiment

Next, a fourth embodiment of the present invention will be described referring to FIG. 7 and FIG. 8. Note that components that are the same as in the above described embodiments are denoted by the same reference numerals and a description of such components is omitted hereunder.

Figure 7:
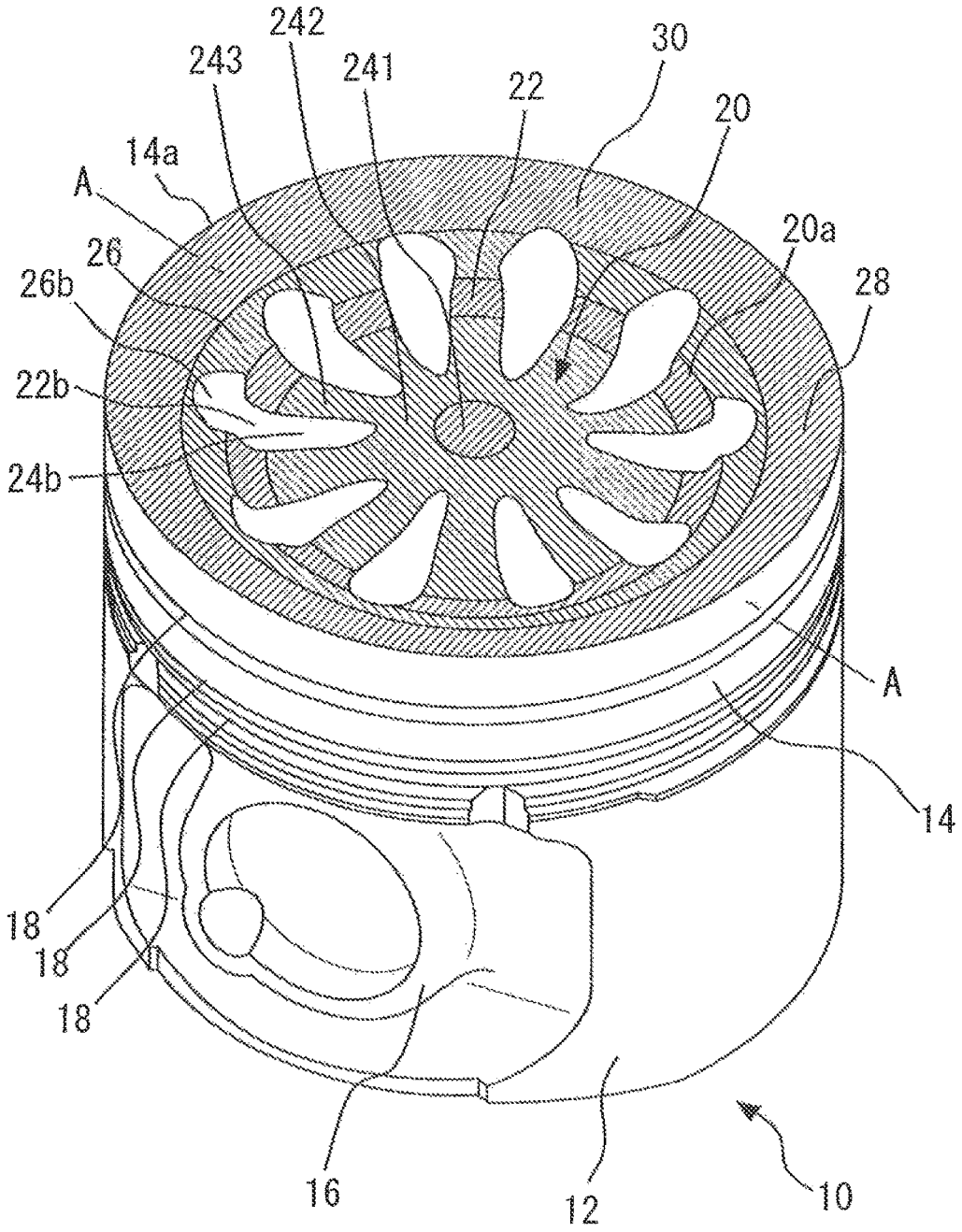
FIG. 7 is a perspective view of a piston that is applied to an internal combustion engine of the fourth embodiment.

FIG. 7 is a perspective view of a piston that is applied to an internal combustion engine of the fourth embodiment. As shown in FIG. 7, a plurality of regions 22*b* in which the anodic oxide film 30 is not formed are provided on the surface of the side wall portion 22. Likewise, a plurality of regions 24*b* in which the anodic oxide film 30 is not formed are provided on the raised face. Furthermore, a plurality of regions 26*b* in which the anodic oxide film 30 is not formed are provided on the tapered face. The regions 22*b* and 26*b* are similar to the regions 22*a* and 26*a* of the third embodiment. On the other hand, the regions 24*b* are different to the regions 24*a* of the third embodiment in the respect that the regions 24*b* are formed only on the surface of the base portion 243.

Figure 8:
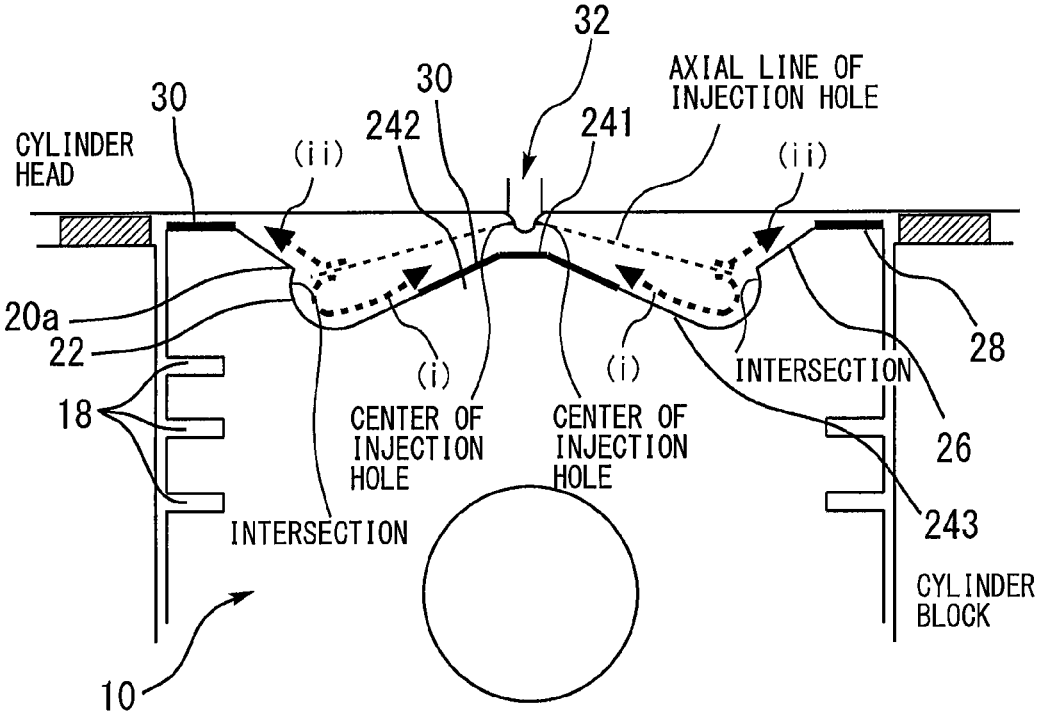
FIG. 8 is a cross-sectional view illustrating the structure of the internal combustion engine of the fourth embodiment.

FIG. 8 is a cross-sectional view illustrating the structure of the internal combustion engine of the fourth embodiment. FIG. 8 corresponds to a cross section A-A in FIG. 7. In FIG. 8, the piston 10 is positioned at the compression top dead center. The reason the regions 24*b* are formed only on the surface of the base portion 243 is the same as the reason described with respect to the second embodiment. That is, since a flame that is at a latter stage of growth contacts the surface of the apex portion 241 and the surface of the mid-slope portion 242, the influence on the combustion rate is small in comparison to the influence of the surface of the base portion 243 that a flame at an initial formation stage contacts.

As described above, similar effects as in the foregoing first embodiment can be obtained according to the present embodiment. Note that the piston 10 described using FIG. 7 and FIG. 8 can be manufactured by subjecting the top face of the piston to an anodic oxidation treatment in a state in which the band-like regions that respectively pass through point of intersections between the surface of the side wall portion 22 and an axial line of an injection hole and also extend to both the squish portion 28 side and the base portion 243 side from the relevant point of intersection are sealed, and thereafter performing a sealing treatment.

Hereunder, other inventions that the present inventors conceived in the course of studies relating to the present invention are disclosed as reference examples. Note that components that are the same as in the above described embodiments are denoted by the same reference numerals and a description of such components is omitted hereunder.

First Reference Example

Figure 9:
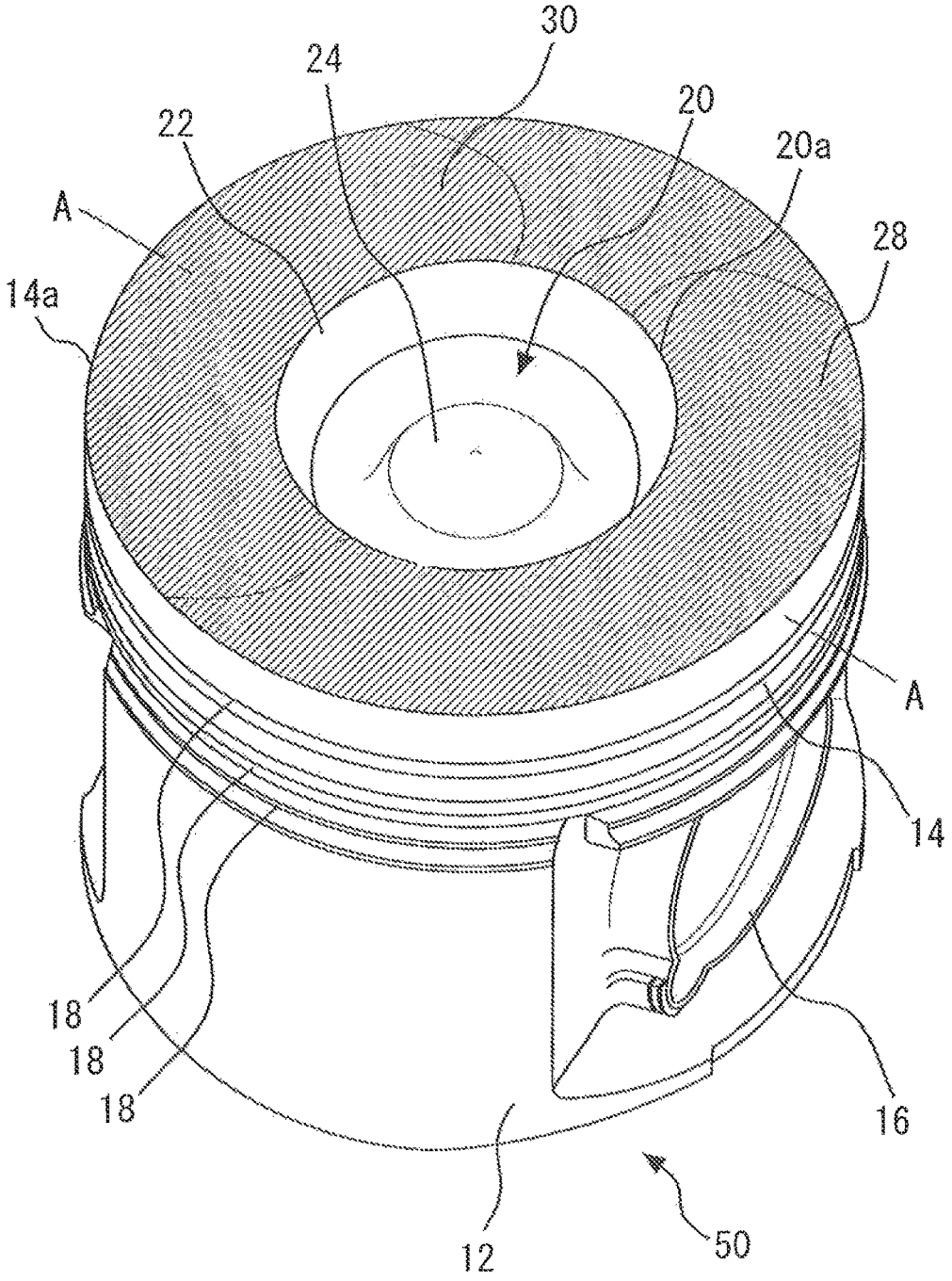
FIG. 9 is a perspective view of a piston that is applied to an internal combustion engine according to a first reference example.

FIG. 9 is a perspective view of a piston that is applied to an internal combustion engine according to a first reference example. A piston 50 illustrated in FIG. 9 differs from the piston 10 of the first embodiment in the respect that a tapered portion is not provided. The anodic oxide film 30 is formed on a squish face, and is not formed on a cavity face.

Figure 10:
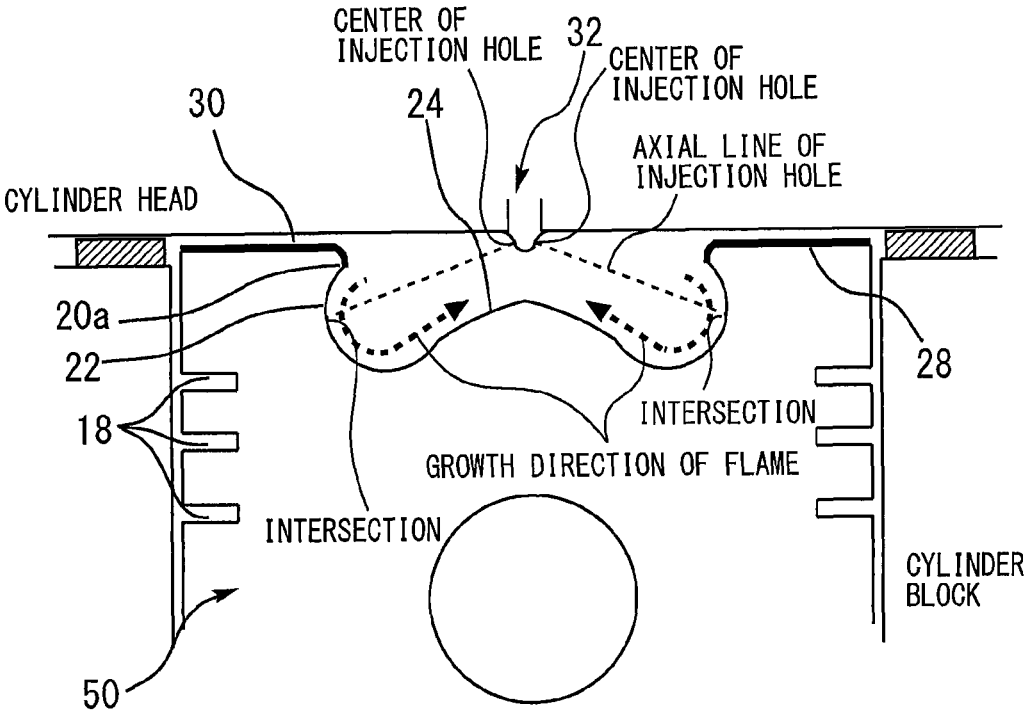
FIG. 10 is a cross-sectional view illustrating the structure of the internal combustion engine of the first reference example.

FIG. 10 is a cross-sectional view illustrating the structure of the internal combustion engine of the first reference example. FIG. 10 corresponds to a cross section A-A in FIG. 9. In FIG. 10, the piston 50 is positioned at the compression top dead center. As described above with respect to FIG. 2, fuel injected from the injection holes of the injection valve 32 is injected towards the side wall portion 22, and the fuel ignites on the way from the injection holes to the side wall portion 22. Broken-line arrows in FIG. 10 show directions in which the flame grows. That is, the flame collides with the surface of the side wall portion 22 and is deflected thereby and grows along the raised face.

As shown in FIG. 10, the anodic oxide film 30 is not formed in the direction in which the flame grows. Therefore, it is possible to favorably suppress the occurrence of a situation in which flame growth is inhibited by the anodic oxide film 30 and the combustion rate (average combustion rate in the cylinder) decreases. Accordingly, a decrease in thermal efficiency accompanying a decrease in the combustion rate, as well as a decrease in the full load performance can be suppressed. That is, the effect produced by the anodic oxide film can be exerted while suppressing a decrease in the combustion rate. The present inventors performed experiments with respect to the internal combustion engine illustrated in FIG. 10 and found that an effect that increases the fuel consumption is obtained in a case where the anodic oxide film is formed over the entire area of the top face of the piston.

Note that the piston 50 described using FIG. 9 and FIG. 10 can be manufactured by subjecting the top face of the piston to an anodic oxidation treatment in a state in which the cavity face is sealed (with a rubber seal or the like), and thereafter performing a sealing treatment.

Second Reference Example

Figure 11:
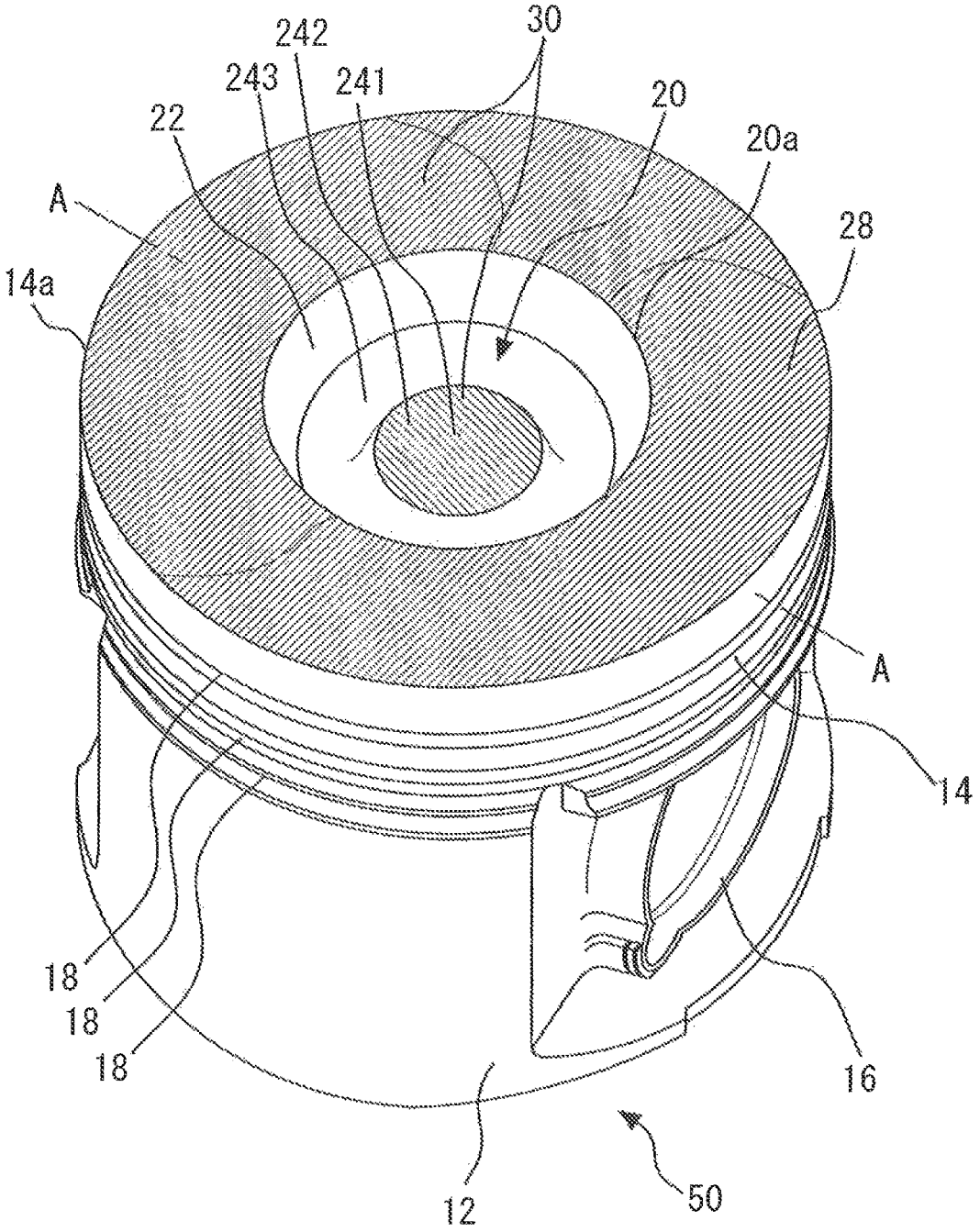
FIG. 11 is a perspective view of a piston that is applied to an internal combustion engine according to a second reference example.

FIG. 11 is a perspective view of a piston that is applied to an internal combustion engine according to a second reference example. As shown in FIG. 11, the anodic oxide film 30 is formed over the entire squish face. The anodic oxide film 30 is also formed on the apex portion 241 and the mid-slope portion 242 of the ridge portion 24. On the other hand, the anodic oxide film 30 is not formed on the surface of the base portion 243 of the ridge portion 24 or the surface of the side wall portion 22.

Figure 12:
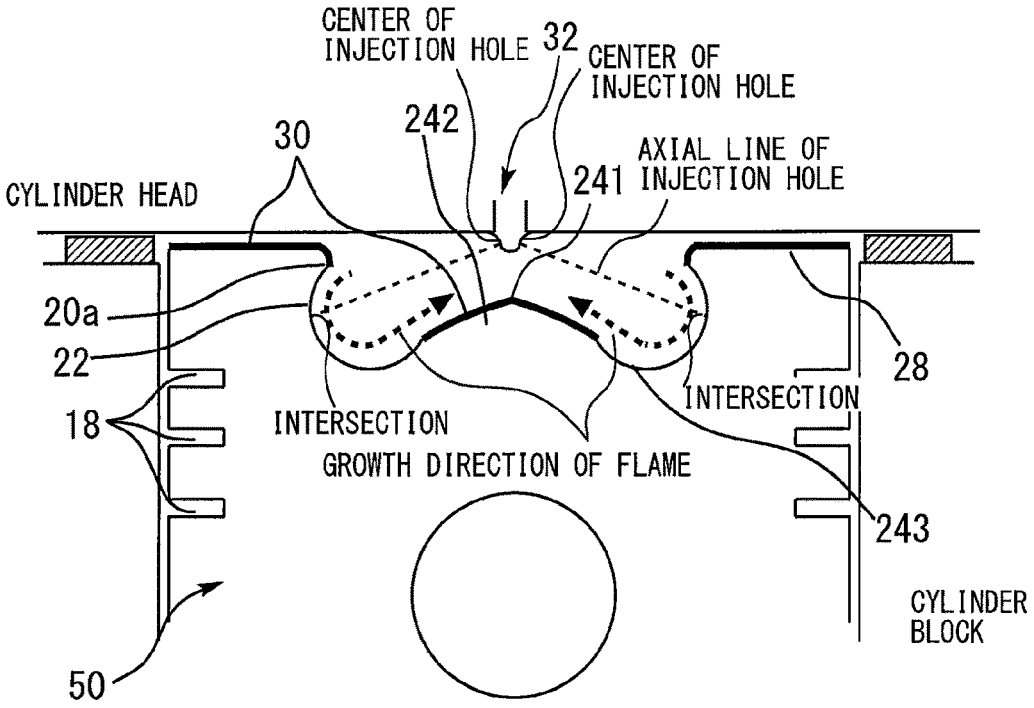
FIG. 12 is a cross-sectional view that illustrates the structure of the internal combustion engine of the second reference example.

FIG. 12 is a cross-sectional view that illustrates the structure of the internal combustion engine of the second reference example. FIG. 12 corresponds to a cross section A-A in FIG. 11. In FIG. 12, the piston 50 is positioned at the compression top dead center. As described above using FIG. 10, the combustion rate decreases if flame growth is inhibited by the anodic oxide film 30. However, although a flame at an initial formation stage contacts the surface of the base portion 243 and the side wall portion 22, a flame that is at a latter stage of growth contacts the surface of the apex portion 241 and the mid-slope portion 242. For this reason, the anodic oxide film 30 is not formed on the surface of the base portion 243 and the side wall portion 22 to thereby suppress inhibition of flame growth, while at the same time, the anodic oxide film 30 is formed on the surface of the apex portion 241 and the mid-slope portion 242, thereby enhancing the effect produced by the film.

As described above, a similar effect as in the foregoing first reference example can be obtained according to the present reference example. Note that the piston 50 described using FIG. 11 and FIG. 12 can be manufactured by subjecting the top face of the piston to an anodic oxidation treatment in a state in which the surface of the base portion 243 and the side wall portion 22 are sealed, and thereafter performing a sealing treatment.

Third Reference Example

Figure 13:
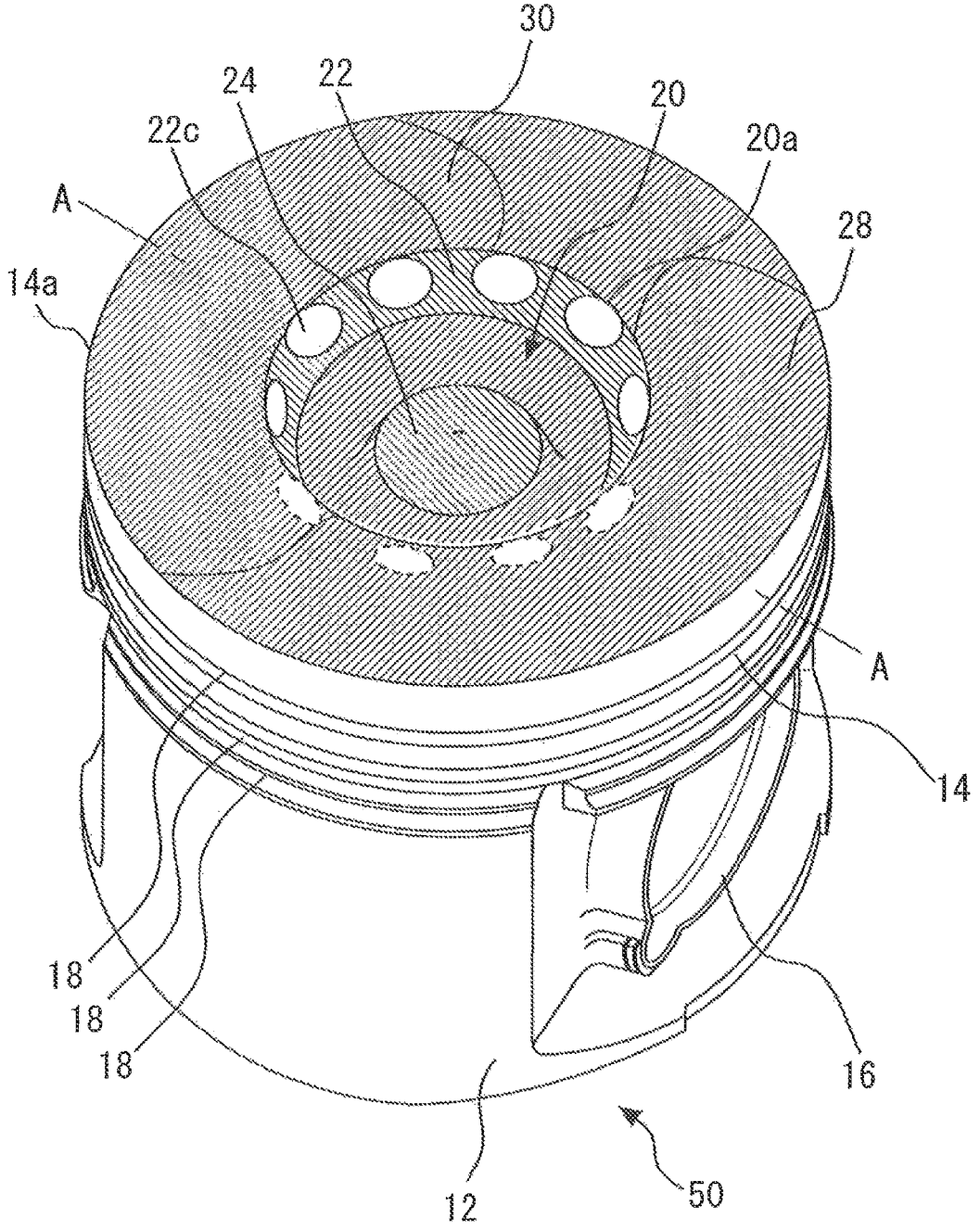
FIG. 13 is a perspective view of a piston that is applied to an internal combustion engine according to a third reference example.

FIG. 13 is a perspective, view, of a piston that is applied to an internal, combustion engine according to a third reference example. As shown in FIG. 13, a plurality of circular regions 22*c* in which the anodic oxide film 30 is not formed are provided on the surface of the side wall portion 22. A diameter Ø of each of the regions 22*c* is 8 mm, and the regions 22*c* are provided at uniform intervals. The number of the regions 22*c* corresponds to the number of injection holes that are radially provided in the tip of the injection valve 32. The anodic oxide film 30 is formed on the top face of the piston, excluding the regions 22*c*.

Figure 14:
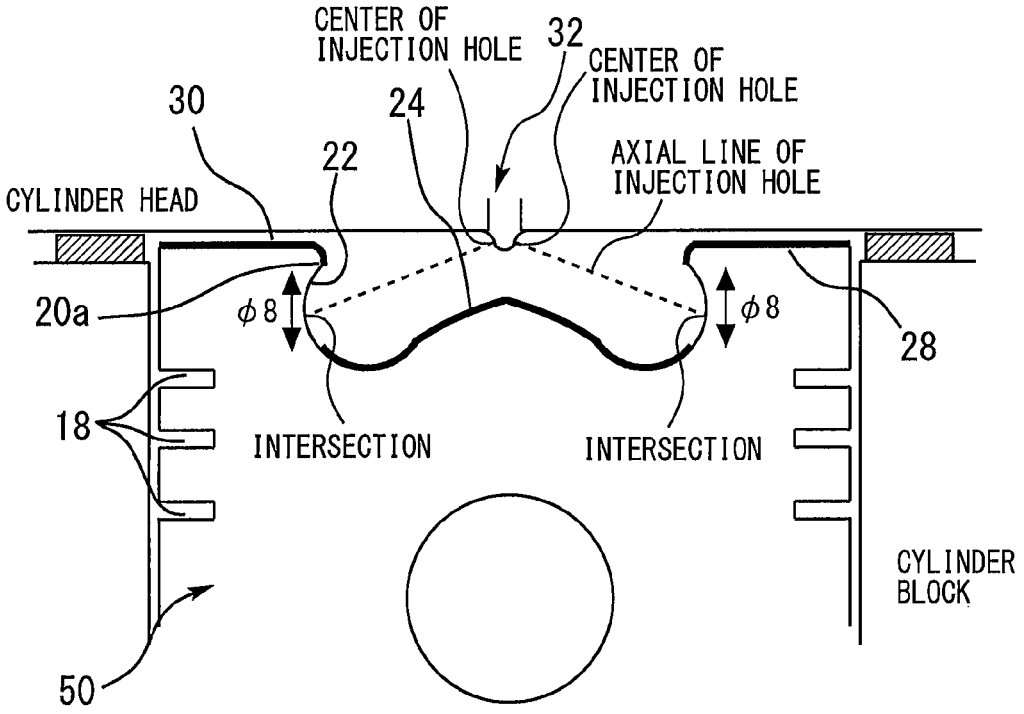
FIG. 14 is a cross-sectional view illustrating the structure of the internal combustion engine of the third reference example.

FIG. 14 is a cross-sectional view illustrating the structure of the internal combustion engine of the third reference example. FIG. 14 corresponds to a cross section A-A in FIG. 13. In FIG. 14, the piston 50 is positioned at the compression top dead center. As described above with respect to FIG. 10, fuel injected from the injection holes of the injection valve 32 is injected towards the side wall portion 22 along axial lines of the injection holes as shown in FIG. 10, and the fuel ignites on the way from the injection holes to the side wall portion 22. Consequently, the part of the top face of the piston that a flame at an initial formation stage first contacts is the side wall portion 22. Since the flame comes in contact with the surface of the side wall portion 22 by colliding therewith, if the anodic oxide film 30 is formed at the place of such contact there is a high possibility that the growth of the flame will be affected as a result. For this reason, the anodic oxide film 30 is not formed in the regions 22*c*.

As described above, a similar effect as in the foregoing first reference example can be obtained according to the present reference example. Note that the piston 50 described using FIG. 13 and FIG. 14 can be manufactured by subjecting the top face of the piston to an anodic oxidation treatment in a state in which circular regions that are centered on points of intersection between the surface of the side wall portion 22 and axial lines of the injection holes are sealed, and thereafter performing a sealing treatment.

Fourth Reference Example

Figure 15:
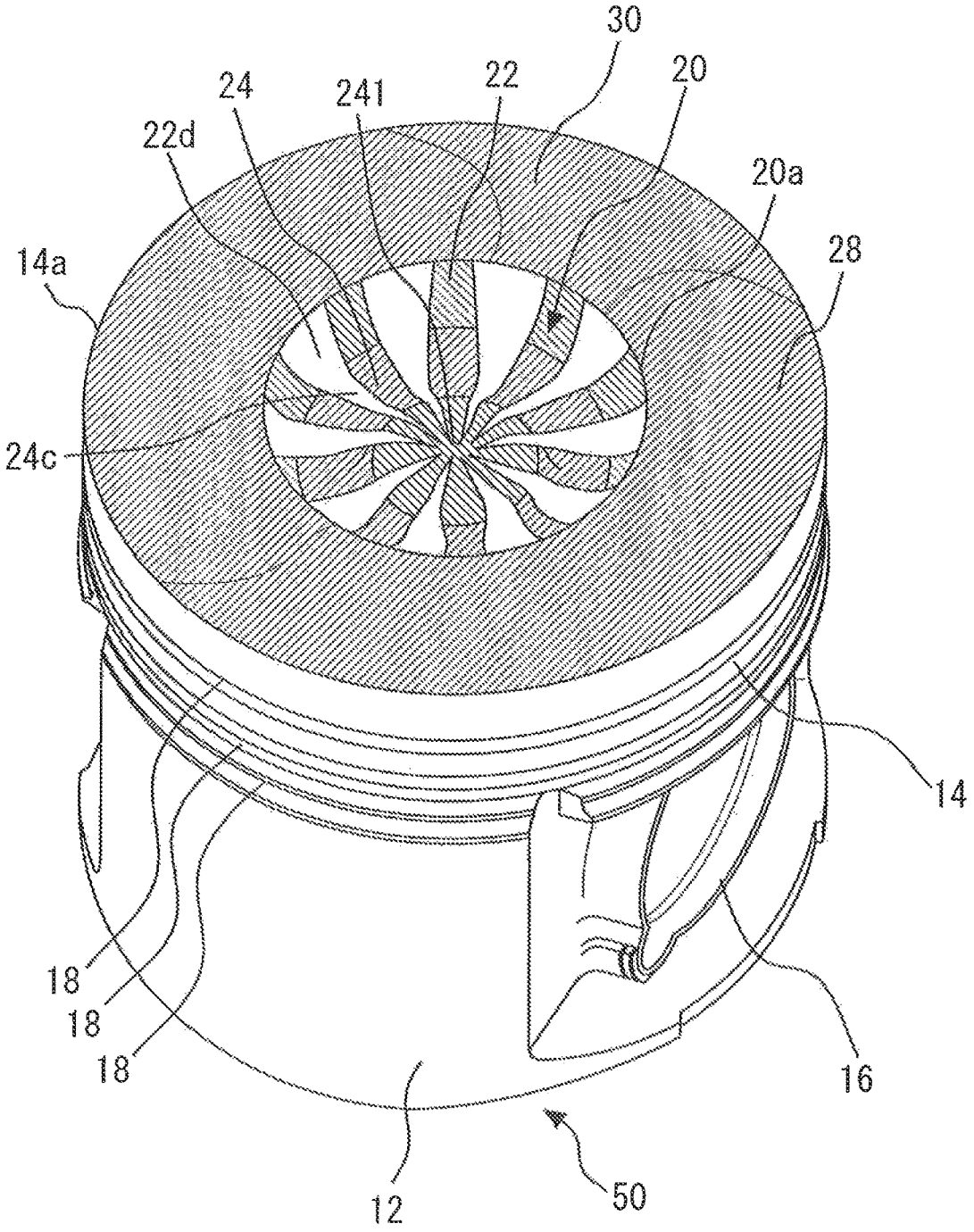
FIG. 15 is a perspective view of a piston that is applied to an internal combustion engine of a fourth reference example.

FIG. 15 is a perspective view of a piston that is applied to an internal combustion engine of a fourth reference example. As shown in FIG. 15, a plurality of regions 22*d* in which the anodic oxide film 30 is not formed are provided on the surface of the side wall portion 22. Likewise, a plurality of regions 24*c* in which the anodic oxide film 30 is not formed are provided on the raised face. The regions 22*d* and 24*c* are provided at uniform intervals, and the respective regions 22*d* and regions 24*c* are formed continuously with each other to form band-like regions. However, the respective band-like regions are not connected to each other. The width of each band-like region is widest on the opening edge 20*a* side, and narrows progressively towards the apex portion 241 side. The number of band-like regions corresponds to the number of injection holes that are radially provided in the tip of the injection valve 32. The anodic oxide film 30 is formed on the top face of the piston, excluding the band-like regions.

In the third reference example, the regions (regions 22*c*) which a flame at an initial formation stage collides with are configured as regions in which the anodic oxide film 30 is not formed. However, since the flame grows along the raised face after colliding with the aforementioned regions, there is a possibility that the combustion rate will decrease somewhat if the anodic oxide film 30 is formed on the raised face. For this reason, according to the present reference example the regions on which the flame grows after colliding (that is, the regions 22*d* and regions 24*c*) are also configured as regions in which the anodic oxide film 30 is not formed, and not just the regions of the side wall portion 22 with which a flame at an initial formation stage collides.

As described above, a similar effect as in the foregoing first reference example can be obtained according to the present reference example. Note that the piston 50 described using FIG. 15 can be manufactured by subjecting the top face of the piston to an anodic oxidation treatment in a state in which the band-like regions that respectively pass through point of intersections between the surface of the side wall portion 22 and an axial line of an injection hole and also extend to both the opening edge 20*a* side and the apex portion 241 side from the relevant point of intersection are sealed, and thereafter performing a sealing treatment.

Fifth Reference Example

Figure 16:
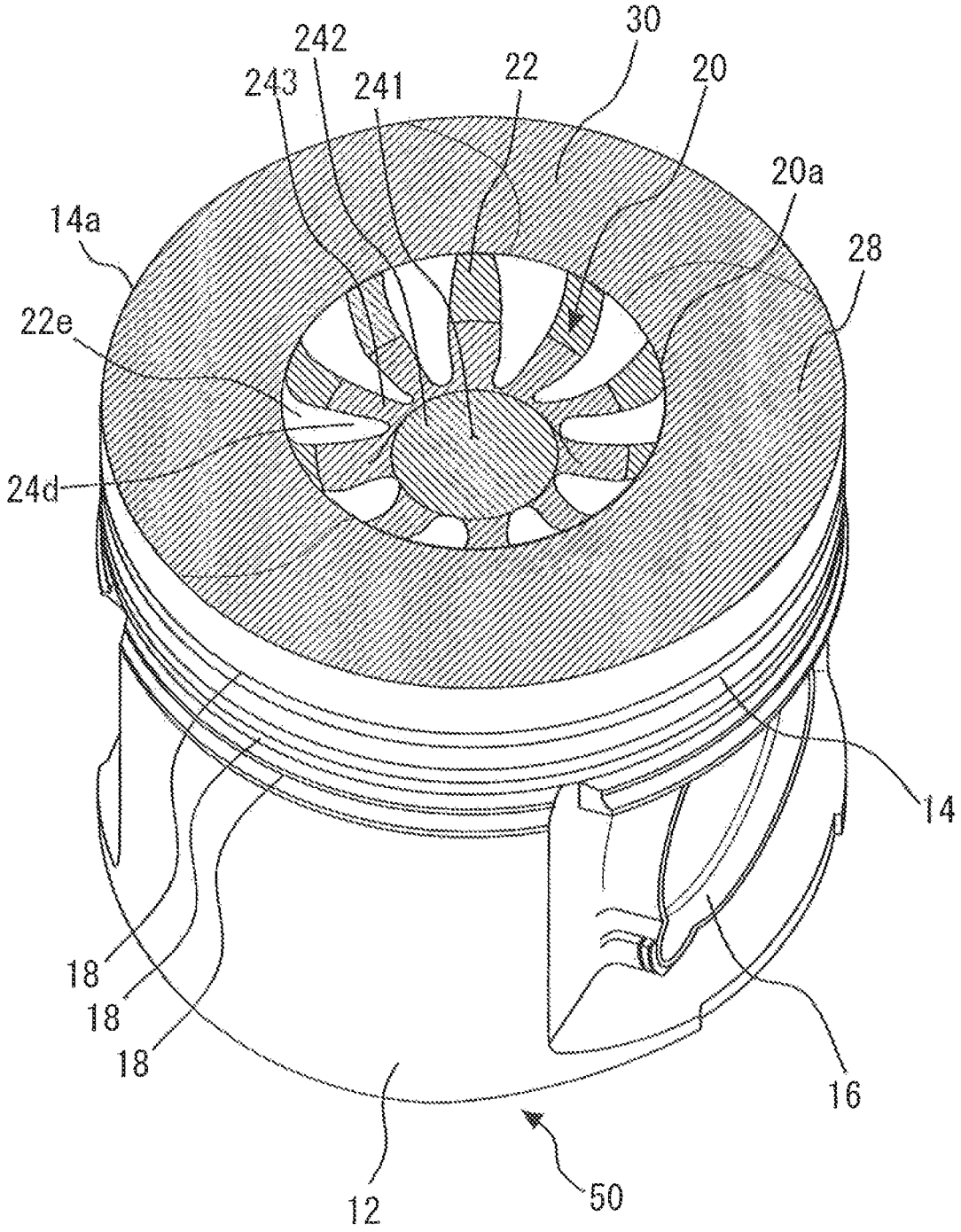
FIG. 16 is a perspective view of a piston that is applied to an internal combustion engine according to a fifth reference example.

FIG. 16 is a perspective view of a piston that is applied to an internal combustion engine according to a fifth reference example. As shown in FIG. 16, a plurality of regions 22*e* in which the anodic oxide film 30 is not formed, are provided on the surface of the side wall portion 22. Likewise, a plurality of regions 24*d* in which the anodic oxide film 30 is not formed are provided on the raised face. The regions 22*e* are similar to the regions 22*d* of the fourth reference example. On the other hand, the regions 24*d* are different to the regions 24*c* of the fourth reference example in the respect that the regions 24*c* are formed only on the surface of the base portion 243.

The reason the regions 24*d* are formed only on the surface of the base portion 243 is the same as the reason described with respect to the second reference example. That is, since a flame that is at a latter stage of growth contacts the surface of the apex portion 241 and the surface of the mid-slope portion 242, the influence on the combustion rate is small in comparison to the surface of the base portion 243 that a flame at an initial formation stage contacts.

As described above, a similar effect as in the foregoing first reference example can be obtained according to the present reference example. Note that the piston 50 described using FIG. 16 can be manufactured by subjecting the top face of the piston to an anodic oxidation treatment in a state in which the band-like regions that respectively pass through points of intersection between the surface of the side wall portion 22 and an axial line of an injection hole and also extend to both the opening edge 20*a* side and the base portion 243 side from the relevant point of intersection are sealed, and thereafter performing a sealing treatment.

Sixth Reference Example

Figure 17:
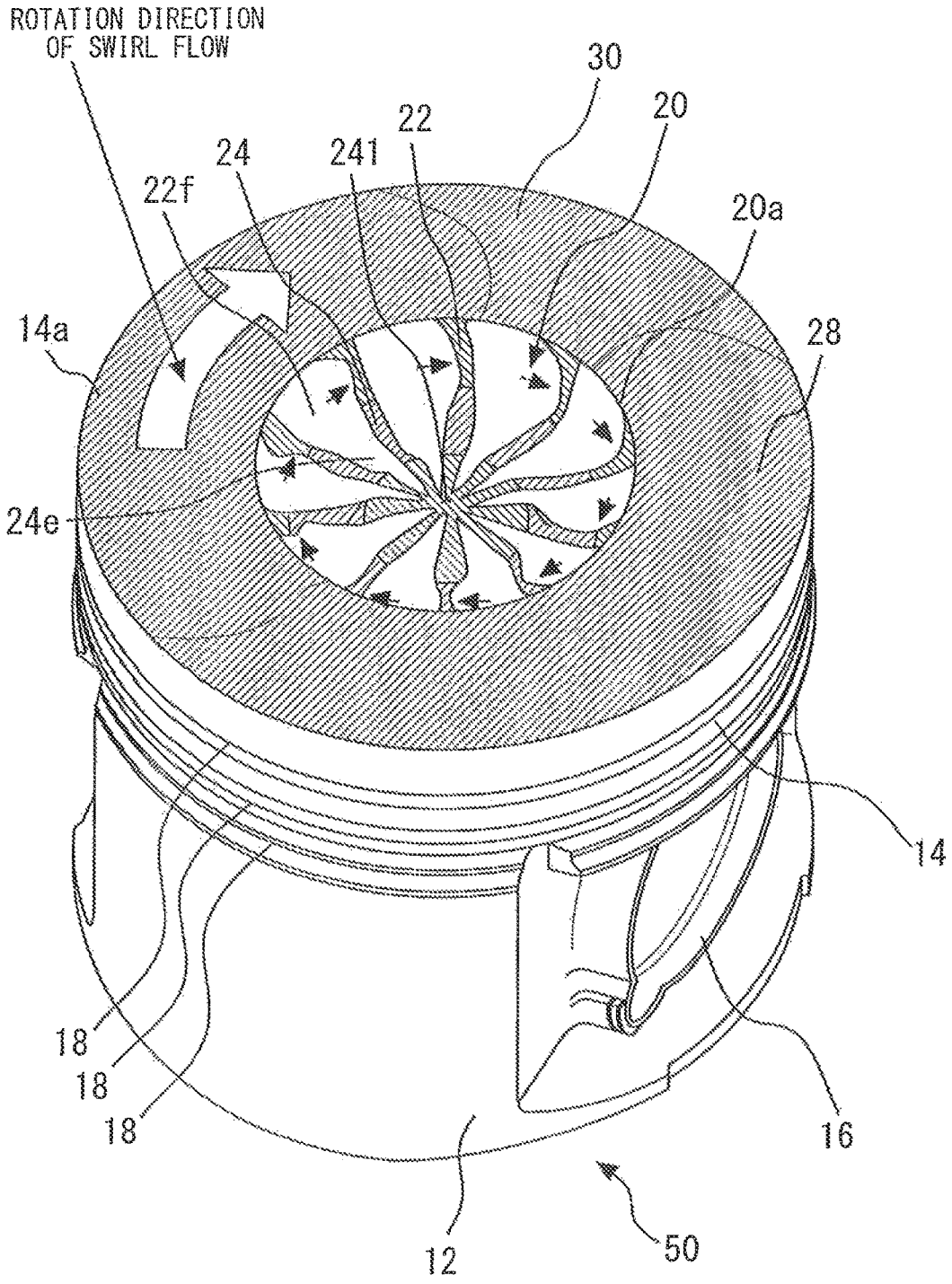
FIG. 17 is a perspective view of a piston that is applied to an internal combustion engine according to a sixth reference example.

FIG. 17 is a perspective view of a piston that is applied to an internal combustion engine according to a sixth reference example. As shown in FIG. 17, a plurality of regions 22*f* in which the anodic oxide film 30 is not formed are provided on the surface of the side wall portion 22. Likewise, a plurality of regions 24*e* in which the anodic oxide film 30 is not formed are provided on the raised face. The regions 22*f* and 24*e* are basically the same as the regions 22*d* and 24*e* of the fourth reference example. However, the regions 22*f* and 24*e* differ from the regions 22*d* and 24*c* of the fourth reference example with respect to the width of the band-like region. The reason is that the internal combustion engine of the present reference example is an internal combustion engine that generates a swirl flow such that air drawn into the cylinder is caused to rotate in the lateral direction and flow in whirls.

When a swirl flow is generated in the direction illustrated in FIG. 17, the flame flows in the rotational direction of the swirl flow. Therefore, if the width of the band-like regions is narrow, there is a possibility that the flame that flows will contact the anodic oxide film 30. For this reason, according to the present reference example the width of the respective band-like regions is widened to suppress the inhibition of flame growth.

Thus, according to the present reference example, a similar effect as in the above described first reference example can be obtained in an internal combustion engine that generates a swirl flow also. Note that the piston 50 described using FIG. 17 can be manufactured in a similar manner to the piston 50 of the fourth reference example.

Seventh Reference Example

Figure 18:
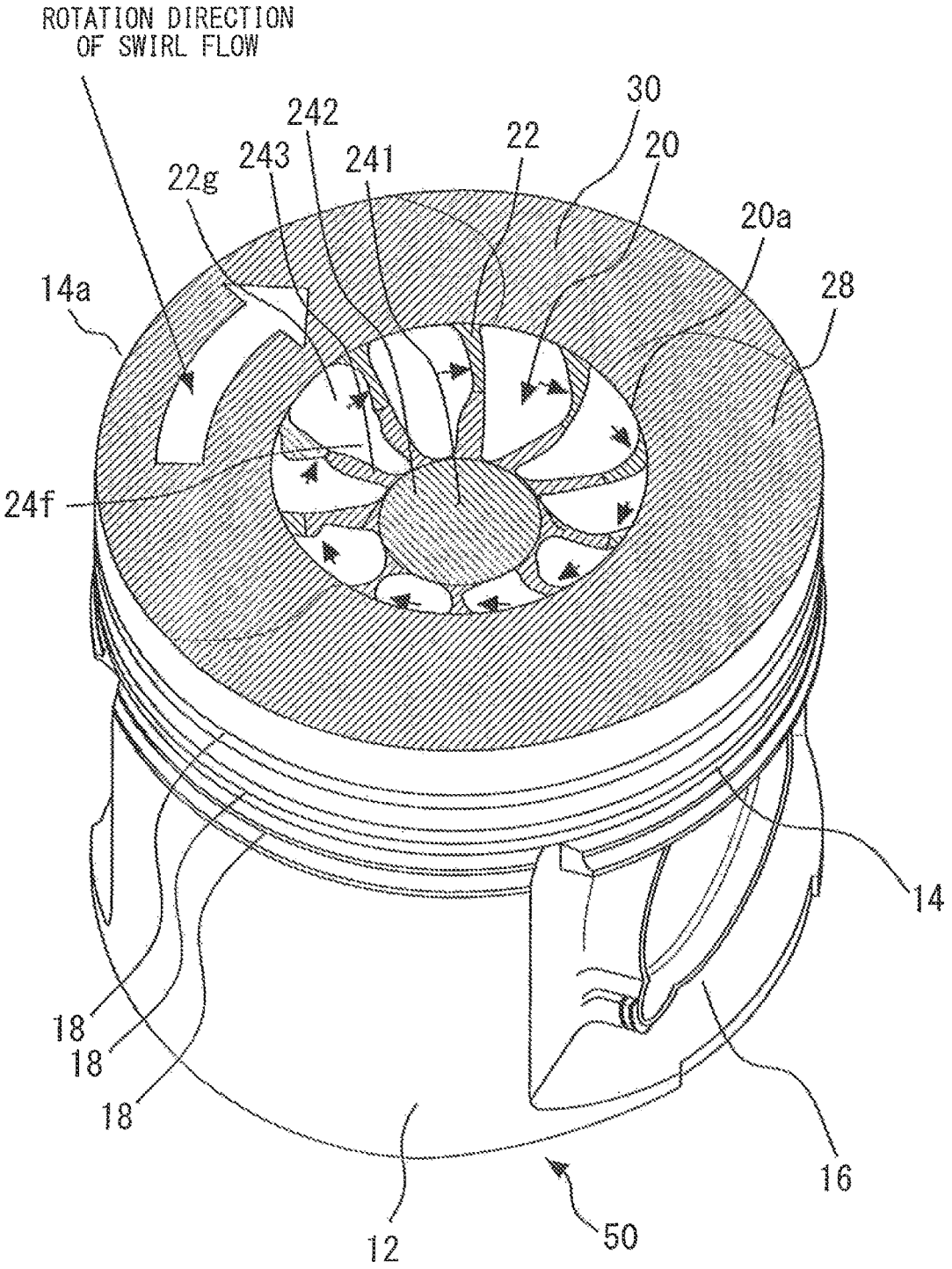
FIG. 18 is a perspective view of a piston that is applied to an internal combustion engine according to a seventh reference example.

FIG. 18 is a perspective view of a piston that is applied to an internal combustion engine according to a seventh reference example. As shown in FIG. 18, a plurality of regions 22*g* in which the anodic oxide film 30 is not formed are provided on the surface of the side wall portion 22. Likewise, a plurality of regions 22*f* in which the anodic oxide film 30 is not formed are provided on the raised face. The regions 22*g* and 22*f* are basically the same as the regions 22*e* and 24*d* of the fifth reference example. However, the regions 22*g* and 22*f* differ from the regions 22*e* and 24*d* of the fifth reference example with respect to the width of the band-like region. The reason is that, similarly to the sixth reference example, the internal combustion engine of the present reference example is an internal combustion engine that generates a swirl flow, Therefore, in the present reference example the width of the respective band-like regions is widened to suppress the inhibition of flame growth.

Thus, according to the present reference example, a similar effect as in the above described first reference example can be obtained in an internal combustion engine that generates a swirl flow also. Note that the piston 50 described using FIG. 18 can be manufactured in a similar manner to the piston 50 of the fifth reference example.

DESCRIPTION OF REFERENCE NUMERALS

10, 50 piston
14 crown portion
14*a* outer edge
20 cavity portion
20*a* opening edge
22 side wall portion
22*a*, 22*b*, 22*c*, 22*d*, 22*e*, 22*f*, 22*g* regions in which an anodic oxide film is not formed
24 ridge portion
24*a*, 24*b*, 24*c*, 24*d*, 24*e*, 24*f* regions in which an anodic oxide film is not formed
26 tapered portion
26*a*, 26*b* regions in which an anodic oxide film is not formed
28 squish portion
30 anodic oxide film
32 injection valve
241 apex portion
242 mid-slope portion
243 base portion

The invention claimed is:

1. An internal combustion engine comprising a piston in which an anodic oxide film is formed on at least one part of a top face that faces a cylinder head, and an injection valve that is capable of injecting a fuel towards the top face, wherein:

the top face includes: a cavity face which comprises a cavity for causing fuel that is injected to ignite, a squish face which comprises an outer circumference of the top face at an outer side of the cavity face, and a tapered face which is formed between the squish face and the cavity face;

a rough surface region in which the anodic oxide film is formed is provided over an entire area of the squish face; and the rough surface region and a smooth surface region in which a surface roughness is less than on the squish face that is provided by formation or non-formation of the anodic oxide film is provided in a region that includes the cavity face and the tapered face, wherein the smooth surface region is provided at least in a region in which a flame caused by fuel from the injection valve contacts at an initial formation stage, and the rough surface region is provided in a region in which the smooth surface region is not provided.

2. The internal combustion engine according to claim 1, wherein:

a plurality of injection holes are radially provided in a tip of the injection valve; and the smooth surface region is provided in band-like regions that, in a case where the piston is positioned at a top dead center, pass through respective points of intersection of the cavity face that intersects with straight lines that pass through respective centers of the injection holes, and also extend from the relevant respective points of intersection to a center of the cavity face and to the squish face.

3. The internal combustion engine according to claim 1, wherein:

a ridge portion that rises from a center of the piston towards the cylinder head is formed at a center portion of the cavity; and the rough surface region is provided on a surface of an apex portion and a mid-slope portion of the ridge portion, and the smooth surface region is provided on a surface of a base portion of the ridge portion.

4. The internal combustion engine according to claim 1, wherein the rough surface region is provided in an entire area of the tapered face.

* * * * *